United States Patent [19]

Behl et al.

[11] Patent Number: 5,067,215

[45] Date of Patent: Nov. 26, 1991

[54] AUTOMATIC ADJUSTING SELVEDGE CONTROL DEVICE FOR A TEXTILE WEB USING MULTIPLE SENSORS

[75] Inventors: Klaus Behl, Neumunster; Karl-Heinz Erren, Aukrug-Homfeld; Ekkehard Mantz, Gross-Kummerfeld, all of Fed. Rep. of Germany

[73] Assignee: Norddeutsche Faserwerke GmbH, Neumunster, Fed. Rep. of Germany

[21] Appl. No.: 579,951

[22] Filed: Sep. 10, 1990

[30] Foreign Application Priority Data

Sep. 13, 1989 [DE] Fed. Rep. of Germany ..... 3931066

[51] Int. Cl.[5] ..... D02H 13/16

[52] U.S. Cl. ..... 28/190; 28/185; 250/561; 242/57; 242/57.1; 226/15

[58] Field of Search ..... 28/190, 191, 185; 226/15; 271/227; 242/57, 57.1; 250/559, 561

[56] References Cited

U.S. PATENT DOCUMENTS

| | | | |
|---|---|---|---|
| 3,461,518 | 8/1969 | Steiwagen et al. | 28/185 |
| 3,633,198 | 1/1972 | Cassaday | 28/185 |
| 4,074,404 | 2/1978 | Schenk | 28/185 |
| 4,438,917 | 3/1984 | Janssen et al. | 271/227 |
| 4,693,460 | 9/1987 | Adamson et al. | 271/227 X |
| 4,974,301 | 12/1990 | Beerli et al. | 28/191 |

FOREIGN PATENT DOCUMENTS

| | | | |
|---|---|---|---|
| 0196579 | 10/1986 | European Pat. Off. | 250/559 |
| 2917666 | 5/1979 | Fed. Rep. of Germany | 28/185 |
| 3219132 | 5/1982 | Fed. Rep. of Germany | 28/185 |
| 3404255 | 2/1984 | Fed. Rep. of Germany . | |

*Primary Examiner*—Werner H. Schroeder
*Assistant Examiner*—John J. Calvert
*Attorney, Agent, or Firm*—Cushman, Barby & Cushman

[57] ABSTRACT

A device for the recognition and readjustment of variations in the cylindrical yarn deposit at the insides of flanges (23,23') of warp beams or sectional warp beams (24) in warping machines has two sensor heads (4,4') with three sensors (1,2,3;1',2',3') at each flange (22,22') and the corresponding switching and control devices.

5 Claims, 2 Drawing Sheets

AUTOMATIC ADJUSTING SELVEDGE CONTROL DEVICE FOR A TEXTILE WEB USING MULTIPLE SENSORS

FIELD OF THE INVENTION

The invention relates to a device for the recognition and readjustment of variations in the cylindrical yarn deposit at the flange sides of warp beams or sectional warp beams in warping machines, in which a width-adjustable reed determines both the width of the yarn sheet and also its position relative to the flange sides.

DESCRIPTION OF THE PRIOR ART

From DE-OS 34 04 255 a device is known for controlling and adjusting the lap build-up, formed from a yarn sheet of ends guided alongside one another, on a warp beam with side flanges for warping machines or beamers. Both the width of the yarn sheet and its position relative to the warp beam are determined by a warping reed. At both ends of the lap, measured-value transmitters are arranged which, depending on the respective lap diameter, transmit a measured value influenced by the diameter of the lap. In addition, at least one target-value transmitter influenced in the same way by the diameter of the lap is provided which is arranged facing inwards next to the measured value transmitters and produces a target value which is compared with the measured values transmitted by the measured value transmitters so as to produce a difference value when there is a divergence between the target value and the measured value. The two difference values thus produced are then linked together such that when the difference values are identical the warping reed alters the width of the yarn sheet and/or when the difference values differ the warping reed moves the yarn sheet.

A disadvantage of the known device is that it does not take into account a change in the position of the flange sides when the lap diameter increases due to the fact that the yarn sheet pushes the flange sides outwards more and more strongly during winding. In the currently usual sectional warp beams (SWBs), the flange sides are pushed several mm outwards towards the end of the winding process. As a result, during the winding of the yarn sheet on to the cylindrical yarn container (SWB) a poor selvedge build-up continually occurs at the flange sides. There can be said to be a poor selvedge build-up when the cylindrical yarn winding does not continue right up to the flange, but the yarn runs out or accumulates at the flange. During operation the warping reed, which guides the yarn ends before they run on to the beam changes direction so as to avoid a mirror-image formation of the wound-on yarn sheet. By means of this reed the width of the yarn sheet is adjusted by a more or less pronounced transverse movement and also by the right- and left-hand limitation relative to the SWB. If this limitation or the inclination or width of the reed is not correctly adjusted, or if changes take place during the winding process, then the aforementioned poor selvedge build-up results. A change occurs inter alia when the pressure on the flange increases with the quantity of yarn wound on and pushes it outwards.

SUMMARY OF THE INVENTION

The task of the invention is to provide a device for the recognition and readjustment of variations in the cylindrical yarn deposit at the flange sides of warp beams or sectional warp beams taking into account the flange excursion.

The task is solved by the device of the type mentioned in the introduction, which is characterized by a sensor head on each flange, which is mounted at the free end of a holding device, and supports a first sensor, a second sensor and a third sensor, which are connected via electrical line to a stored-programmable control system, the second and third sensor being aligned with each other such that they transmit and receive their signals at an angle of 90° while the first sensor is arranged and aligned in between at an angle of 45°; by a bidirectional table, which under the effect of two stepping motors controlled by the control system moves the holding device in two directions which are perpendicular to each other; and by two reed motors which are also controlled by the control system, one of which moves the reed parallel to the axis of the sectional warp beam while the other adjusts its width.

In this way the sensor head always maintains the same distance from the flange side of the beam and from the outer diameter of the winding and therefore can recognize and readjust the width and orientation of the yarn sheet to the target point.

Preferably, the first and second sensors are infra-red sensors, while the third sensor is an inductive sensor.

The first IR sensor conveniently has its focal point about 2 mm in front of the flange on the yarn so that it can register any divergence from the ideal final position, positive or negative, of about 0.1 mm.

The second IR sensor has a larger measuring field and conveniently maintains a constant distance of about 8 mm from the yarn.

The third sensor, as an inductive sensor, holds the sensor head at a constant distance from the flange of the sectional warp beam and therefore holds the first IR sensor exactly in its position. By processing the signals of the fist sensor, the reed can be controlled for guiding the yarn sheet. The invention is explained in more detail in the following using figures; these show:

FIG. *2a–h*, winding faults on sectional warp beams.

DETAILED DESCRIPTION OF THE INVENTION

Figure 1:
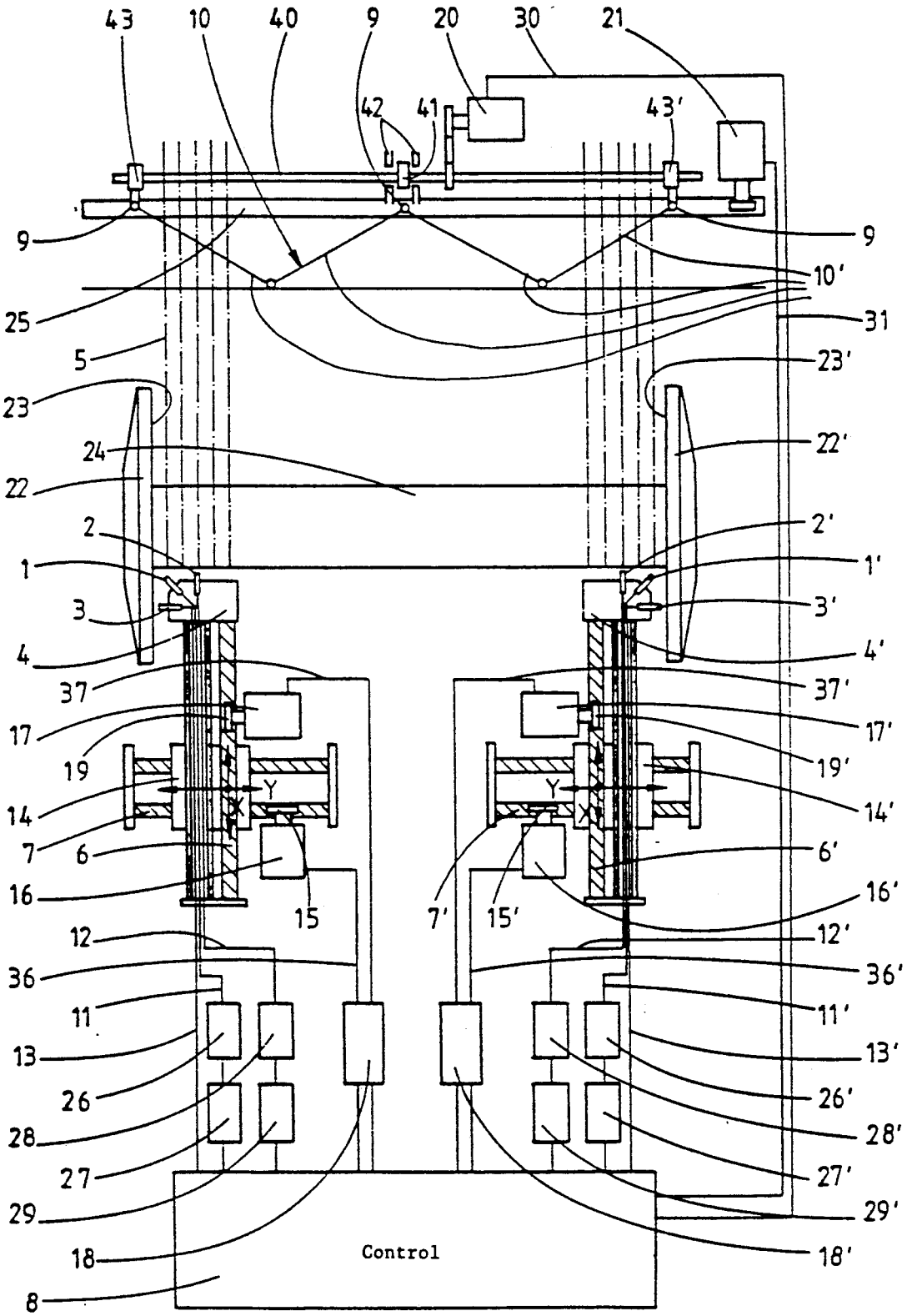
FIG. 1, a diagrammatic representation of the embodiment.
Figure 2:
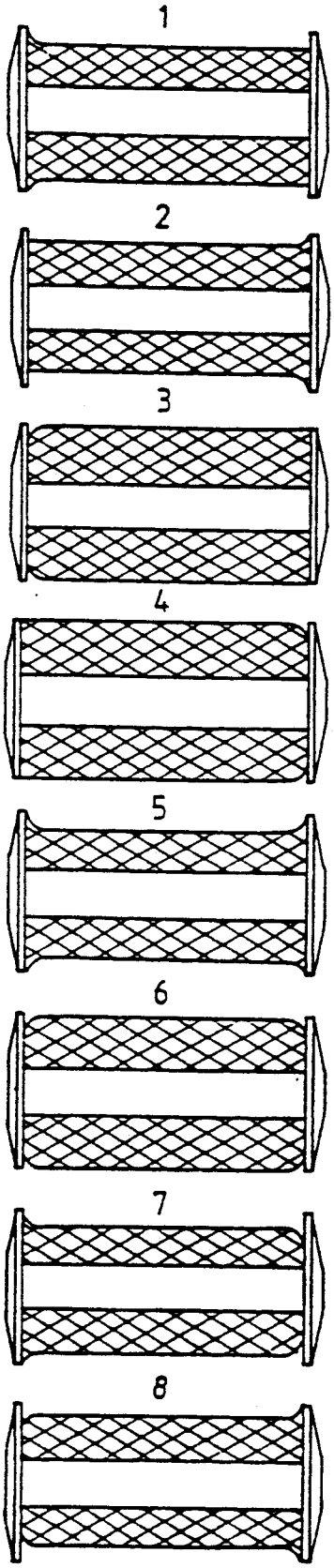

FIG. 1 shows in diagrammatic representation a yarn sheet 5, which is wound from a creel, not shown, via a width-adjustable reed 10, a so-called expanding reed, onto a sectional warp beam 24. For this the reed 10 has a number of hinged points 9, which are movable to and fro in a guide 25 in a manner to be explained below. In this way, the individual reed teeth 10' can be pulled apart to a greater or lesser extent and as a result the width of the yarn sheet 5 is changed.

Reference is made to the fact that in place of an expanding reed, another type of reed, for example, a rotatable reed, can be used. A rotatable reed is not pulled apart but is swivelled about a point of rotation to change the width of the yarn sheet.

For the adjustment of the width of the yarn sheet 5, a first reed motor 20 is used which is controlled by a control system 8 such as a computer and which receives its control commands via a line 30. Via an indicated gear wheel transmission system, the first reed motor 20 drives a screw spindle 40 which has a collar 41 in the middle which is supported in bearings 42 against lateral displacement. A reed construction of this type is generally known to those skilled in the art. The screw spindle 40 carries a nut 43,43' in the region of each of its end on which two of the hinged points 9 are arranged. If the first reed motor 20 sets the screw spindle 40 in rotation, the nuts 43 and 43' are displaced in the axial direction of the screw spindle 40 and as a result pull the hinged points 9 apart in a first rotational direction, while they are pushed together in a second rotational direction.

A second reed motor 21 serves to displace the reed 10 parallel to the axis of the sectional warp beam 24, by which means the yarn sheet 5 can be displaced laterally with respect to the flanges 22,22'. The second reed motor 21 is also steered by the control system 8, suitable control commands being supplied via a line 31.

In the following the essential part of the invention, namely the sensor head 4, is described. In the drawing, one sensor head of essentially identical construction is shown for both the right-hand and left-hand side of the sectional warp beam 24. The individual parts are therefore provided with the same reference numbers; they differ only by an apostrophe. For reasons of clarity in the following only the left-hand sensor head 4 is described. It is shown positioned approximately in the middle of FIG. 1 at the inner flange side 23 of the flange 22 of the sectional warp beam 24.

The sensor head 4 is attached on the free end of a holding device 6, which is mounted on a bidirectional table 14. A person skilled in the art can be expected to construct a suitable holding device without further instructions, for example, by providing a profile with a rack, not shown, which can be moved to and fro on its longitudinal axis by the pinion 19 of a stepping motor 17. It is clear that the rack for this purpose must be guided in bearings, not shown. In this way the sensor head 4 can be moved by the stepping motor 17 in a first or X-direction, which conveniently runs radially relative to the sectional warp beam 24. A further directional movement of the sensor head 4, namely in the Y-direction, enables it to move the sensor head 4 parallel to the axis of the sectional warp beam 24. This is possible using the bidirectional table 14 in a manner which is also known per se, for example by the holding device 6 being movable on a bed 7 arranged at a right-angle thereto perpendicular to its longitudinal extension. For example, another stepping motor 16 can be used for this, whose pinion 15 engages with a rack, also not shown, mounted on the bed 7. The two stepping motors 16 and 17 are steered by the control system 8 via lines 36 and 37.

FIG. 1 also shows details of the sensor head 4, which carries the three sensors 1, 2 and 3. The first and second sensor 1 and 2 are infra-red sensors, while the third sensor 3 is an inductive sensor. The second sensor 2 and the third sensor 3 are mounted aligned with each such that their radiant axes form an angle of 90°. In between these the first sensor 1 is mounted with a radiant direction of 45°. The first IR sensor 1 is directed to the point of the ideal final winding of the sectional warp beam 24. During operation its sensor focal point lies about 2 mm in front of the flange on the yarn.

The second IR sensor 2 transmits infra-red radiation radially on to the wound-on yarn, which is reflected and received radially again. It is to maintain a constant distance of, for example, about 8 mm from the yarn.

The third sensor 3 is an inductive sensor which is directed on to the inside 23 of the flange and is to hold the sensor head 4 at a constant distance from the flange 22. The signals of the three sensors 1–3 are transmitted via lines 11, 12 and 13 after processing by analogue amplifiers 26, 28 and threshold-value switches 27, 29 of the control system 8 which is a stored-programmable control system.

FIGS. *2a–h*, shows eight faulty windings of a sectional warp beam, which are compensated by the three sensors 1–3 via the stored-programmable control system 8 (SPS) with the help of the stepping motors 16 and 17 and the reed motors 20 and 21.

Faults *2a–d* are corrected by width-alteration and displacement of the reed 10.

Faults *2e–f* are corrected only by width-alteration of the reed 10.

Faults g and h are corrected by displacement of the reed 10.

DESCRIPTION OF FUNCTION

Sensor 1,1'

The first sensor 1,1' is held exactly in its position by the sensors 2,2' and 3,3'. If, for example, it recognizes a positive excursion of the winding (selvedge running-up), this effects a positive alteration of the 0–20 mA output of its sensor amplifier. This current is supplied to a first analogue amplifier 26. The working range of the first analogue amplifier 26 is 0–100 % and the limits can be varied as required. Its output voltage accordingly is 0–10 volts d.c. voltage. This voltage is converted in a downstream first threshold-value switch 27 into a definite switch point and sets a relay, not shown. The relay picks up an input in the stored-programmable control system (SPS) 8. Likewise the signals of the other sensors 2 and 3 and the sensors 1', 2' and 3' go to the other side of the beam. Via corresponding different connections, for a certain time one or more of the SPS-outputs are active. They act on the two reed motors 20 and 21. The first reed motor 20 moves the reed 10 to the right or to the left, while the other reed motor 21 adjusts the width of the same reed 10, through which the width of the yarn sheet 5 is changed. Sensors 2 and 3 act on the stepping motors 16 and 17, and sensors 2' and 3' act on the stepping motors 16' and 17' and thus position the sensors 1 and 1'.

Sensor 2,2'

The sensors 2,2' have the task of holding the sensors 1,1' exactly at the same distance (e.g. 8 mm) from the wound-on yarn. They operate in principle in the same way as the sensors 1,1' and on recognizing a reduction in distance, through their sensor amplifier, switch to either one or a second analogue amplifier 28, or a second threshold-value switch 29 of the SPS 8 and a control unit 18 or a first stepping motor 17,17'. This moves the holding device 6, on which the sensor head 4,4' is mounted, away from the yarn, until the set value is achieved.

Sensor 3,3'

The distance of each sensor head 4,4' from the flange is registered by the sensor 3,3', an inductive proximity switch. It has the advantage that differently coloured yarn containers SWB can be used. If the proximity switch detects that the flange is at too great a distance from the switch, then this report goes directly to the SPS 8 and via a linkage at time intervals addresses the other stepping motor 16, again via the motor control unit 18. In this way the sensor head 4,4' is brought back to the same distance from the flange 22 by the moving out of the holding device 6.

At the beginning of warping, namely when using a new sectional warp beam, it is necessary to move the whole measurement device into the starting position very close to the sectional warp beam 24. Likewise, at the end of the warping process, a quick and uninterrupted removal must be ensured. This is achieved by additional measuring elements and processing in the SPS 8 in a manner known per se to one skilled in the art.

The analogue and threshold-value switches can be omitted if the SPS offers the possibility of processing sensor signals like these two devices.

We claim:

1. A device for controlling the take up of yarn on a beam with a movable reed, and comprising at least one sensor head mounted on a holding device, said sensor head having a first, a second and a third sensor with each connected by an electrical line to a programmable control means, said second and third sensors extending at an angle of 90° with respect to each other and said first sensor extending at an angle of 45° with respect to both said second and third sensors, said holding device being carried on support means for moving said holding device along a first and a second axis which extend perpendicularly to one another, said support means including first and second motor means each for effecting movement along one of said axes of said holding device, said motor means being connected to and operated by said control means, a first reed moving motor for moving said movable reed parallel to said beam and a second reed motor for adjusting the lap width of said movable reed, said reed motors each being connected to and controlled by said control means.

2. The device as claimed in claim 1, wherein said first and second sensors are infra-red sensors and said third sensor is an inductive sensor.

3. The device as claimed in claim 1, wherein another sensor head is provided with each sensor head being disposed to monitor said beam adjacent a said side flange.

4. The device as claimed in claim 1, wherein said movable reed is an expanding reed.

5. The device as claimed in claim 1 wherein said movable reed is a rotatable reed mounted for rotation about a rotation point to change the width of the yarn sheet, said device including a stepping motor for effecting rotation of said rotatable reed.

* * * * *